US006240663B1

(12) United States Patent
Robinson

(10) Patent No.: US 6,240,663 B1
(45) Date of Patent: Jun. 5, 2001

(54) STREAMLINED RESILIENT CONNECTION SYSTEM FOR ATTACHING A WEAR MEMBER TO AN EXCAVATING LIP STRUCTURE

(75) Inventor: Howard W. Robinson, Grapevine, TX (US)

(73) Assignee: G. H. Hensley Industries, Incorporated, Dallas, TX (US)

( * ) Notice: Subject to any disclaimer, the term of this patent is extended or adjusted under 35 U.S.C. 154(b) by 0 days.

(21) Appl. No.: 09/664,918

(22) Filed: Sep. 18, 2000

(51) Int. Cl.[7] ..... E02F 9/28
(52) U.S. Cl. ..... 37/458; 37/455
(58) Field of Search ..... 37/448–458; 403/374.3, 403/374.4, 379.3, 379.5, 379.1

(56) References Cited

U.S. PATENT DOCUMENTS

| | | | |
|---|---|---|---|
| 1,868,247 | 7/1932 | Page . | |
| 2,385,395 | 9/1945 | Baer | 37/142 |
| 2,393,706 | 1/1946 | Page | 37/142 |
| 3,371,437 | 3/1968 | Wilson et al. | 37/142 |
| 3,919,792 | 11/1975 | Hahn et al. | 37/142 R |
| 4,086,713 | 5/1978 | White | 37/142 A |
| 4,414,764 | 11/1983 | Johansson et al. | 37/141 T |
| 4,748,754 | 6/1988 | Schwappach | 37/141 R |
| 5,653,048 | 8/1997 | Jones et al. | 37/452 |
| 5,713,145 | 2/1998 | Ruvang | 37/458 |
| 5,937,549 | 8/1999 | Bender et al. | 37/455 |

*Primary Examiner*—Christopher J. Novosad
(74) *Attorney, Agent, or Firm*—Konneker & Smith, P.C.

(57) ABSTRACT

A spaced series of generally C-shaped wear members, representatively excavating tooth adapters, are positioned on a front edge portion of a lip structure on, for example, an excavating bucket, by placing the lip edge portion between rearwardly extending top and bottom leg portions of each wear member. Spring-loaded, low profile attachment structures are mounted within top leg recesses of the wear members prior to the installation of the wear members on the lip structure. After the wear members are in place on the lip structure, the internally disposed attachment structures are secured to the lip structure at open rear ends of the top wear member legs in a manner causing the internal attachment structures to resiliently bias their associated wear members in rearward self-tightening directions relative to the lip structure. Protective shrouds are then connected to the open rear ends of the top wear member legs to conceal and protect their internally carried attachment structures. The wear members disposed at opposite lower corners of the bucket overlap bottom and inner and outer side portions of corner structural sections Of the bucket to shield them from operational abrasion.

39 Claims, 12 Drawing Sheets

STREAMLINED RESILIENT CONNECTION SYSTEM FOR ATTACHING A WEAR MEMBER TO AN EXCAVATING LIP STRUCTURE

BACKGROUND OF THE INVENTION

The present invention generally relates to excavating apparatus and, in a preferred embodiment thereof, more particularly provides improved apparatus for removably attaching a wear member, such as an excavating tooth adapter, to the lip portion of an excavating device such as a bucket, dipper or the like.

Large excavating buckets, dippers or the like are typically provided with a series of earth-cutting teeth which are each formed from two primary parts—a relatively large adapter and a relatively small replaceable point. The adapter has a base portion which is connectable to the forward lower lip of the bucket, and a nose portion onto which the tooth point is removably secured by a suitable connecting pin or other connecting structure. Compared to that of the adapter, the useful life of the point is rather short—the adapter typically lasting through five or more point replacements until the tremendous earth forces and abrasion to which the adapter is subjected necessitates its replacement.

Various structures have been previously proposed for removably attaching adapters, and other wear members such as wear shrouds, to excavating lip structures. For example, in U.S. Pat. No. 5,713,145 to Ruvang a wear shroud having a generally C-shaped cross section is removably attached to the front edge of an excavating bucket lip by first placing the front lip edge in the interior of the wear shroud so that the top and bottom legs of the shroud respectively extend along the top and bottom sides of the lip. A rear end portion of the top shroud leg is then removably secured, using a J-bolt inserted into the top leg after the wear shroud is positioned on the bucket lip, to a base structure welded to the top side of the lip. A nut threaded onto the J-bolt at the rear end of the top shroud leg and facing the welded base structure prevents the forward removal of the installed wear shroud from the bucket lip.

While this particular wear member-to-lip attachment system has proven to be well suited for its intended purpose, it has several limitations and disadvantages. For example, the attachment system requires that the adapter portion of each adapter/tooth point assembly have a relatively high frontal projection area which increases the resistance to penetration of the adapter/tooth point assembly into the material being excavated. Additionally, the adapter-to-lip attachment structure is exposed to the material being excavated, and is thus subject to undesirable abrasion wear. Additionally, the rear portion of the installed adapter tends to promote excavated material "build-up" thereon which, in turn, undesirably decreases the available excavating payload of the bucket.

From the foregoing it can readily be seen that a need exists for improved wear member-to-excavating lip attachment apparatus which will eliminate or at least substantially reduce these limitations and disadvantages. It is to this need that the present invention is directed.

SUMMARY OF THE INVENTION

In carrying out principles of the present invention, in accordance with a preferred embodiment thereof, an excavating device, representatively an excavating bucket, is provided with a wear protection system extending along a front edge portion of its lower lip plate section. The wear protection system includes a series of specially designed wear members, illustratively excavating tooth adapters, which are mutually spaced apart along the length of the front lip edge portion.

Each wear member has a generally C-shaped configuration with a front portion from which first and second legs rearwardly extend along opposite sides of a cavity removably receiving a part of the front lip edge portion, the first leg of each wear member having an interior area. Illustratively, the first legs of the wear members are top legs thereof and extend rearwardly along the top side of the excavating lip, and the second legs of the wear members are bottom legs thereof and extend rearwardly along the bottom side of the excavating lip.

A series of connection sections are carried on the excavating lip, representatively on its top side, and are spaced apart along its length. Additionally, attachment structures are associated with the wear members, and removably secure them to the excavating lip structure.

Each of the attachment structures has a portion which is (1) supported within the interior area of the top leg of its associated wear member for movement with the wear member onto the front lip edge portion of the excavating lip structure, (2) removably connected to one of connection sections, and (3) forwardly and rearwardly movable relative to the wear member and its associated connection section. Biasing structures are associated with the attachment structures and resiliently bias the wear members rearwardly relative to the front edge portion of the excavating lip structure to impart to the removably installed wear members a self-tightening force relative to the front lip edge portion to automatically compensate for operational wear at the adapter/lip interface area.

In a preferred embodiment of the wear members, the top leg of each wear member has an inner or bottom side, and the interior area of the top leg is defined by a depression extending inwardly through its inner side and opening outwardly through a rear end thereof. The top leg of each wear member has a projecting portion extending into the interior area thereof, and the attachment structure portion includes (1) a body portion disposed forwardly of the projecting portion, (2) a first portion extending rearwardly from the body portion and being slidably interengaged with the projecting portion for forward and rearward movement relative thereto, and (3) a second portion extending rearwardly from the body portion, the second portion being secured to one of the connection sections and being rearwardly movable relative to the projecting portion to move the body portion rearwardly toward the projecting portion. The biasing structure includes a spring structure interposed between the body portion and the projecting portion and being compressible therebetween in response to movement of the body portion toward the projecting portion.

Illustratively, in each of the spaced series of wear members, the projecting portion includes a spaced pair Of bosses having openings extending therethrough, the first portion includes a spaced pair of parallel first and second rods extending rearwardly from the body portion and slidably received in the openings in the spaced pair of bosses, the second portion includes a third rod extending rearwardly from the body portion parallel to and between the first and second rods, and the spring structure includes a pair of coiled compression springs circumscribing the first and second rods between the body portion and the bosses. Preferably, retaining structures carried by the first and second rods captives retain them in their associated boss openings.

Preferably, each of the connection sections has a hole extending therethrough between front and rear side surface portions thereof, and, in each of the attachment structures the third rod has a threaded rear end portion and extends rearwardly through an associated one of the connection section holes. The attachment structure further includes a nut member threaded onto the threaded rear end portion of the nut member and bearing against the rear side surface portion of the associated connection section and maintaining the springs on the first and second rods in compression. Each of the nut members preferably has an axially elongated configuration with a faceted end surface complementarily engaging an associated faceted rear side surface area of the associated connection section.

The specially designed configurations of the attachment structures in their preferred embodiment provides the installed wear members, which are illustratively excavating tooth adapters, with low profile configurations which desirably reduce their projected frontal areas and increase their earth penetration efficiencies.

The wear members are preferably provided with streamlined shroud structures which are removably connected to and cover their open rear ends. This desirably prevents excavating material from entering the interiors of the top wear member legs and abrading the attachment structures concealed and captively retained therein. The streamlined shroud structures also function to reduce the amount of excavated material which builds up at the rear ends of the top wear member legs, thereby desirably increasing the effective payload of the excavating bucket.

In a preferred embodiment of these wear member rear end shrouds, at each of the top wear member legs the shroud structure and the rear end of the top leg have releasably interlocked portions, representatively interlocked flanged and grooves, the rear end of the top leg has a first pair of mounting holes disposed on opposite sides thereof, and each of the shroud structure has a second pair of mounting holed disposed on opposite sides thereof and aligned with the first pair of mounting holes, and a retaining pin structure is releasably received in the aligned first and second pairs of mounting holes.

According to another aspect of the invention, the excavating lip structure has an end portion perpendicularly connected to a wall structure at a corner section of the bucket, and one of the spaced apart series of wear members is a differently configured corner wear member. The corner wear member, in a preferred embodiment thereof, removably receives the corner section and outwardly extends and shields from abrasion (1) inner and outer side portions of the wall structure, (2) a bottom side portion of the lip structure adjacent the wall structure, and (3) a front edge portion of the wall structure.

In a preferred embodiment thereof, the excavating apparatus further comprises a series of lip protectors captively and releasably retained on the front edge portion of the excavating lip, the lip protectors having top side portions interdigitated with the top legs of the wear members, and bottom side portions underlying and shielding from abrasion the bottom legs of the wear members. A series of depending support members are anchored to the bottom side of the lip structure and are spaced apart along its length. The lip protectors are releasably interlocked with the support members and the wear members and are forwardly removable from the front edge portion of the excavating lip structure. The excavating apparatus also representatively further comprises a series of excavating tooth points removably mounted on the front portions of the wear members and blocking the forward removal of the lip protectors from the front edge portion of the excavating lip.

DETAILED DESCRIPTION

Figure 1:
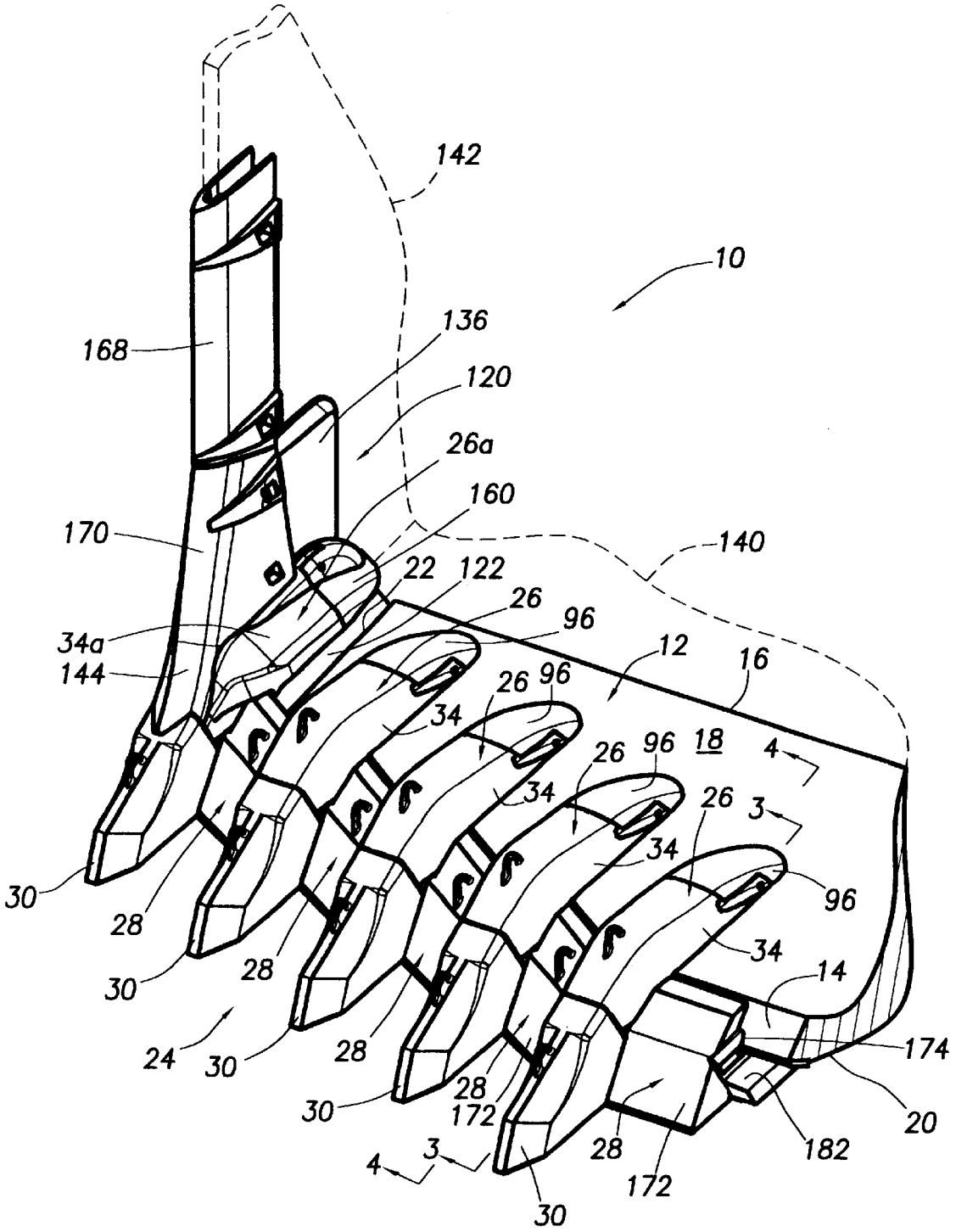
FIG. 1 is a partially phantomed front and top side perspective view of a portion of a representative excavating bucket incorporating therein a specially designed wear protection system embodying principles of the present invention.
Figure 2:
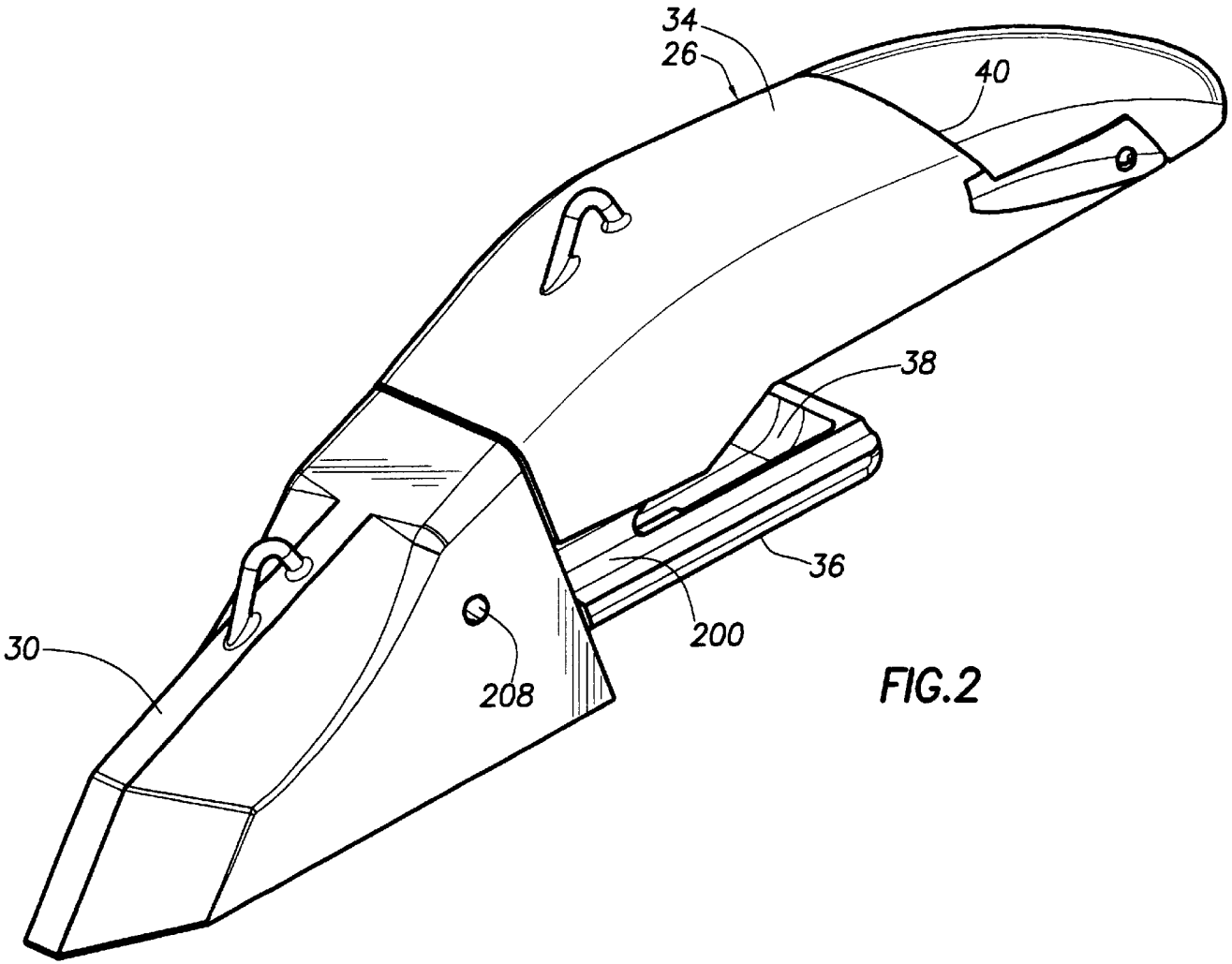
FIG. 2 is an enlarged scale front and right side top perspective view of an excavating tooth assembly removed from the bucket.

Perspectively illustrated in FIG. 1 is an excavating device, representatively an excavating bucket 10, having along a bottom side thereof an elongated lip plate 12 with front and rear edges 14 and 16, top and bottom sides 18 and 20, and a pair of opposite ends including a left end 22 shown in FIG. 1. Extending along a front edge portion of the lip plate 12 is a specially designed wear protection system 24 which embodies principles of the present invention and shields certain portions of the lip plate 12, and other subsequently described portions of the bucket 10, from operational abrasion wear.

The wear protection system 24 includes a spaced apart series of wear members 26, including a differently configured corner wear member 26*a*, which are representatively excavating tooth adapters; a spaced apart series of lip protectors 28, and a spaced apart series of replaceable excavating tooth points 30 removably secured to the adapters 26 in a conventional manner. While the wear members 26 are illustratively excavating tooth adapters, it will be readily appreciated by those of skill in this particular art that they could be other types of wear members such as, for example, wear shrouds.

With reference now to FIGS. 1–7, the adapters 26 are spaced apart along the length of the lip plate 12. Each of the adapters 26 has a front or nose portion 32 from which top and bottom legs 34 and 36 rearwardly extend along a cavity 38 that removably receives a front edge portion of the lip plate 12, with the top leg 34 extending rearwardly along the top side 18 of the lip plate 12 and having a rear end 40, and the bottom leg 36 extending rearwardly along the bottom side 20 of the lip plate 12.

A series of connection members 42 (see FIGS. 3, 5 and 6) are welded to the top side 18 of the lip plate 12 in a spaced apart relationship along its length, and are aligned with the adapters 26 and rearwardly extend from the front lip edge 14. Each connection member 42 has a downwardly and forwardly sloped front end portion 44 which extends along a similarly sloped top surface 14*a* of the front lip edge portion 14 (see FIG. 3), and a rear end portion 46 with a top side recess 48 formed therein. At the front side of the recess 48 is an upstanding boss 50 having front and rear sides 52,54 and a circular opening 56 extending therethrough between the front and rear sides 52,54. An annular faceted area 58 (see FIG. 6) is formed in the rear side 54 and circumscribes the circular opening 56. A front top side recess 60 is formed in the connection member 42 and extends between its sloped front end portion 44 and the front side 54 of the boss 50.

Figure 6:
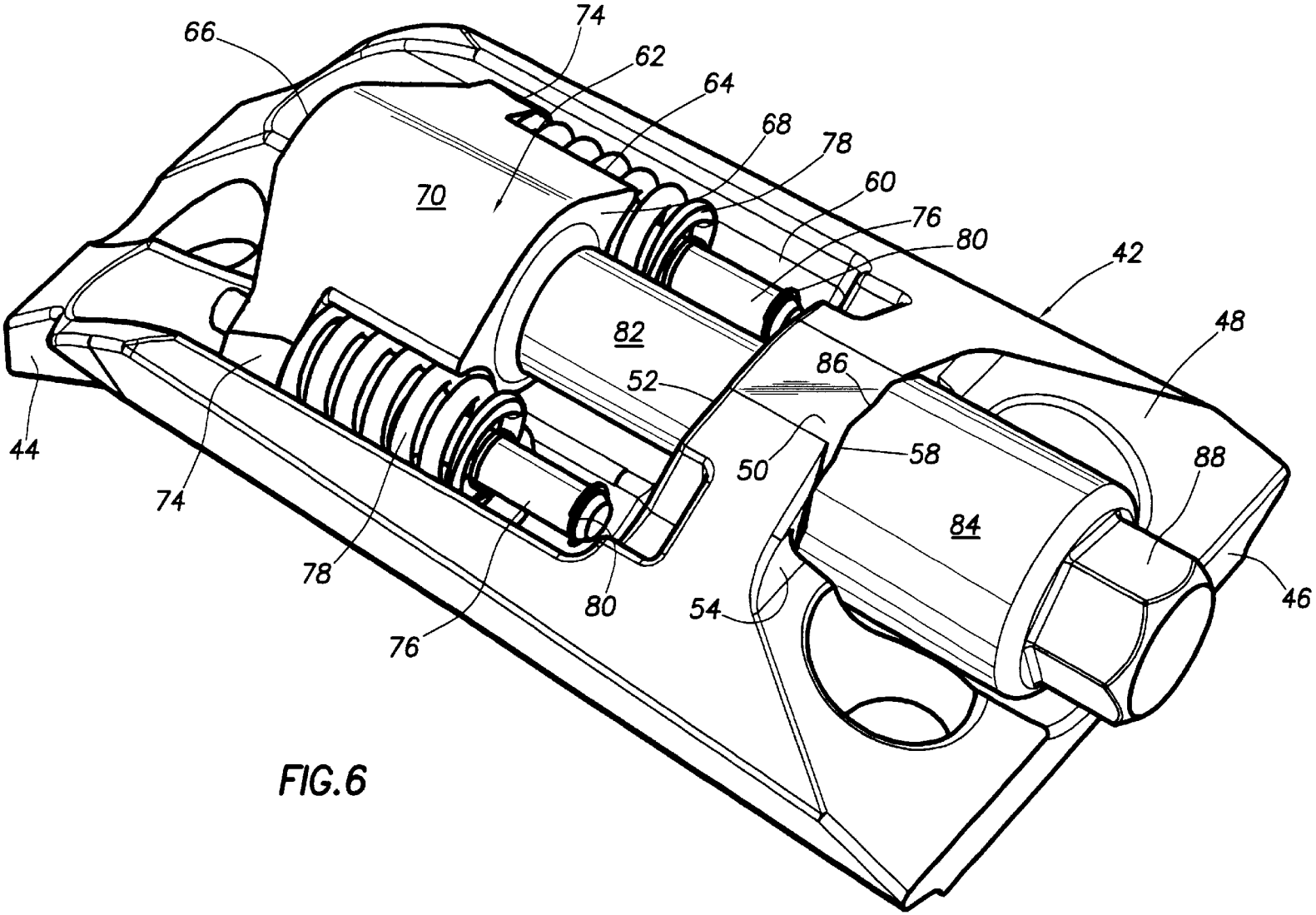
FIG. 6 is a rear and right side top perspective view of the mounting base illustrating how a specially designed resilient connection structure, captively retained within the interior of an adapter, interfits with and is secured to the mounting base.
Figure 7:
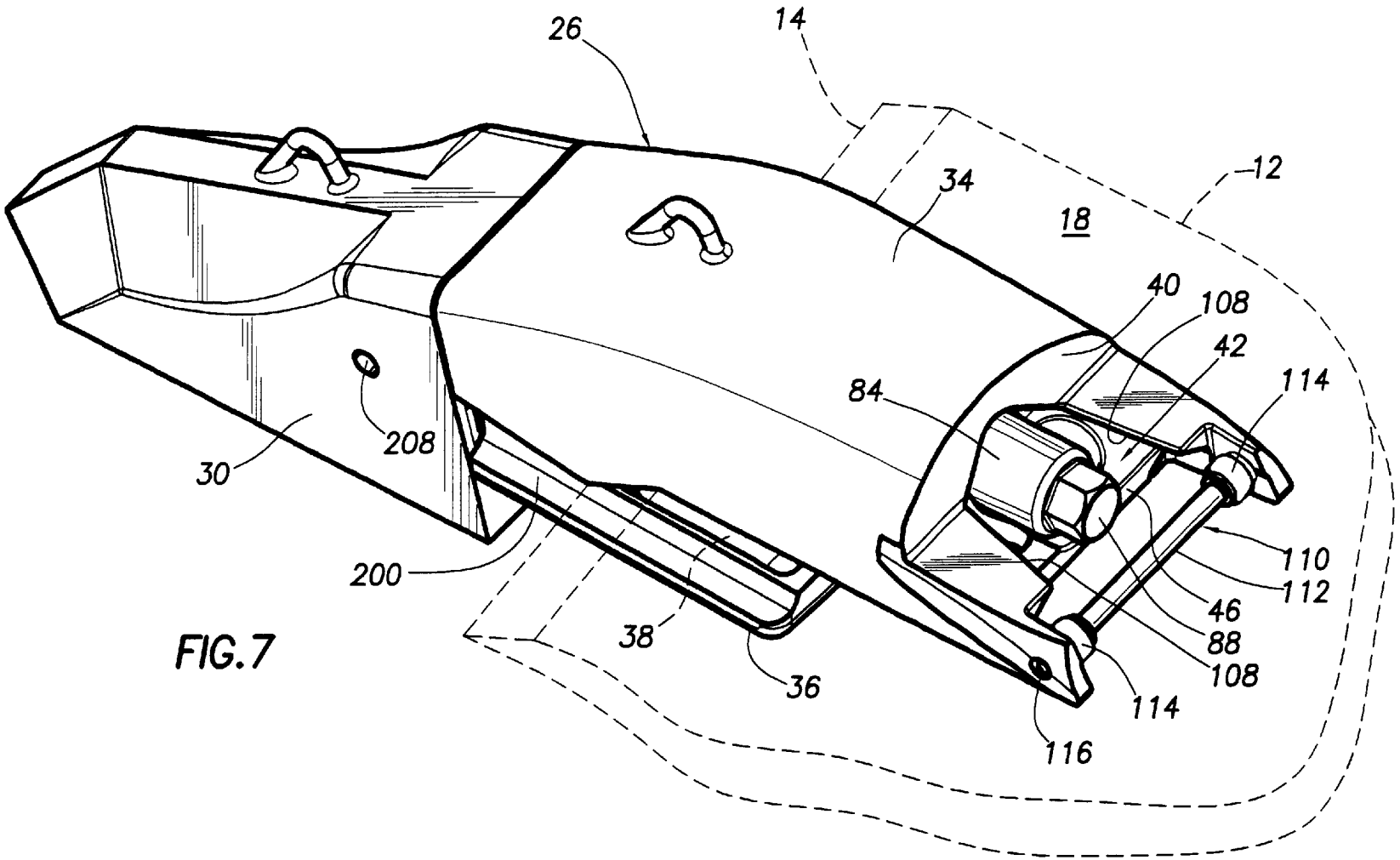
FIG. 7 is a rear and right side top perspective view of an excavating tooth assembly illustrating its connection to a phantomed lip plate portion Of the excavating bucket.
Figure 17:
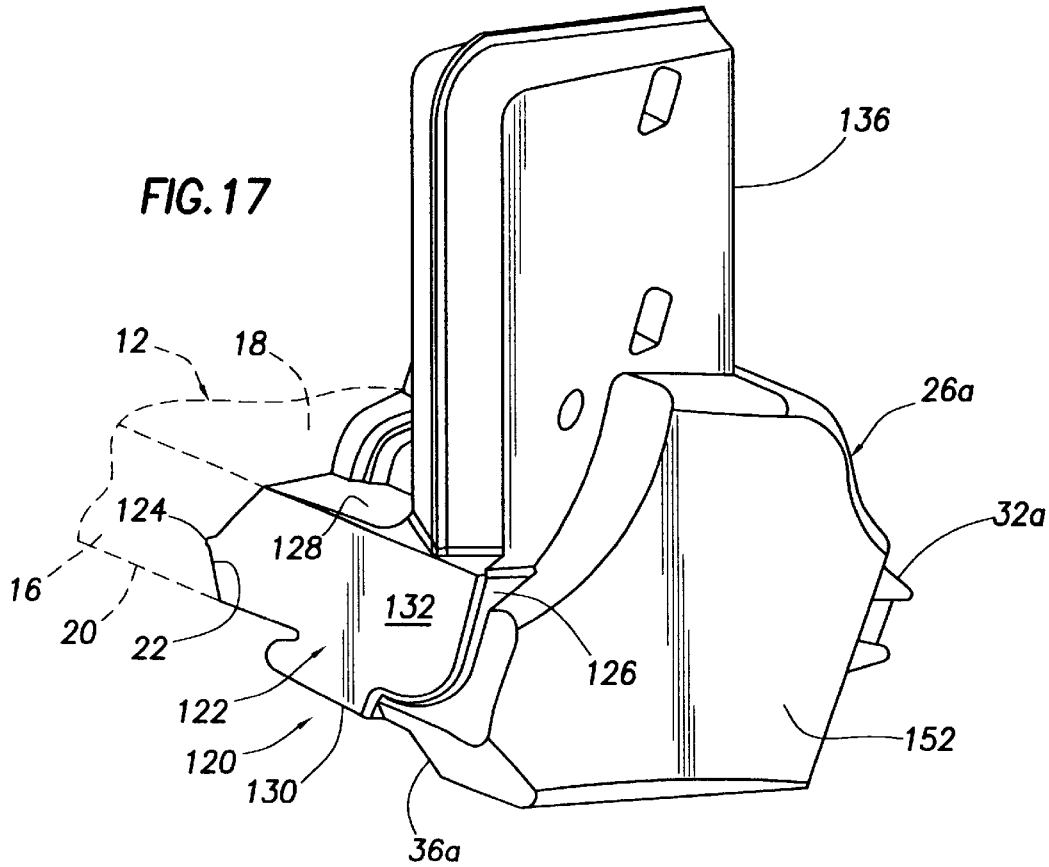
FIG. 17 is an outer end and rear side perspective view of part of the excavating bucket corner portion illustrating the protective interfit therewith of a corner adapter portion of the wear protection system.
Figure 8:
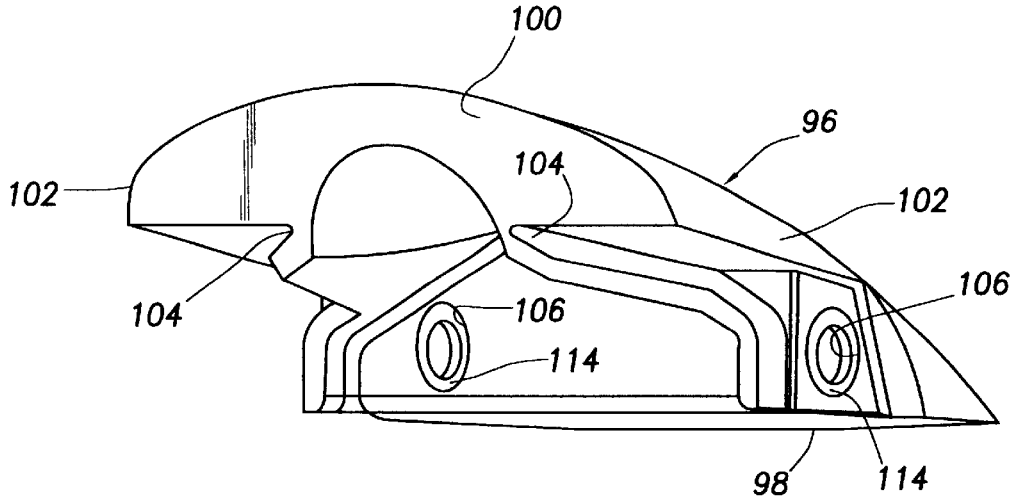
FIG. 8 is a right and front side perspective view of a rear end shroud portion of an excavating tooth assembly.
Figure 10:
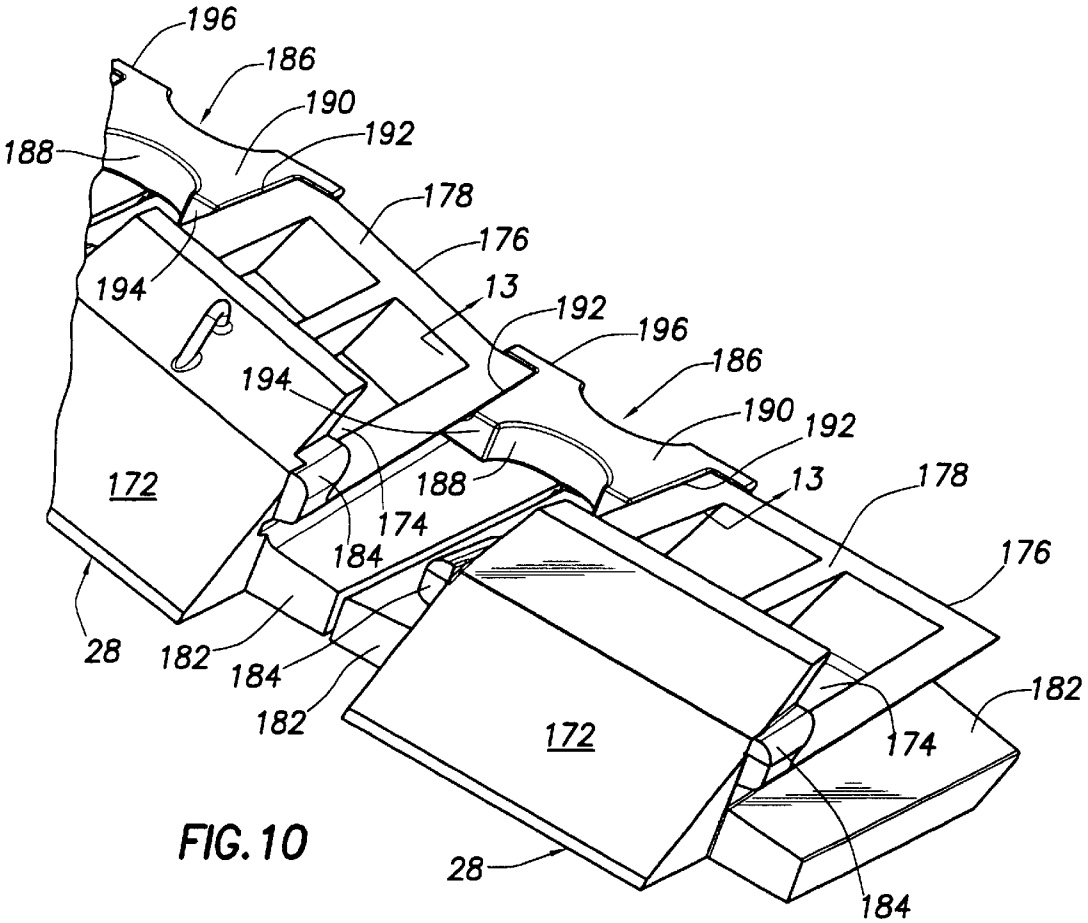
FIG. 10 is a front top side perspective view of a pair of lip protectors partially illustrating their interfit with a base member welded to the bottom side of the front lip plate portion of the excavating bucket.

As shown in FIG. 6, each adapter 26 has associated therewith a specially designed attachment structure 62 which, as later described herein, releasably retains the adapter 26 on its associated portion of the lip plate 12 and resiliently biases the adapter 26 rearwardly relative to the lip plate 12 in a self-tightening manner which automatically maintains a close front-to-rear fit between the adapter and the lip plate to compensate for operational wear at their interface areas.

Each attachment structure 62 includes a body portion 64 having front and rear ends 66 and 68, top and bottom sides 70 and 72, and horizontally outwardly projecting flanges 74 disposed on opposite horizontal sides of the body 64 at its front end 66. A spaced apart parallel pair of rods 76 longitudinally extend rearwardly from the flanges 74, are circumscribed by coiled compression springs 78, and have snap ring type retaining members 80 removably installed on their rear ends. A third, larger diameter rod 82 longitudinally extends rearwardly from the rear end 68 of the body 64, between and parallel to the rods 76, and has a threaded rear end portion 82*a* (see FIG. 3). Each attachment structure 62 also includes an axially elongated cylindrical nut member 84 having an annular faceted front end surface 86 configured to complementarily engage the annular faceted boss surface 58 on the connection member 42 (see FIG. 6) and a noncircularly cross-sectioned driving section 88 at its rear end.

In FIG. 6, for purposes of illustrative clarity, the attachment structure 62 has been shown secured to its associated connection member 42, but without its associated adapter 26. As cross-sectionally illustrated in FIGS. 3 and 4, the body, rod and spring portions 64,76,82,78 of the overall attachment structure 62 are carried by the adapter 26 for movement therewith onto the lip plate 12 and securement to the connection member 42 in a manner later described herein. More specifically, this portion of the attachment structure is captives retained within a depression 90 formed in the underside of the top adapter leg 34 and opening outwardly through its rear end 40.

Figure 4:
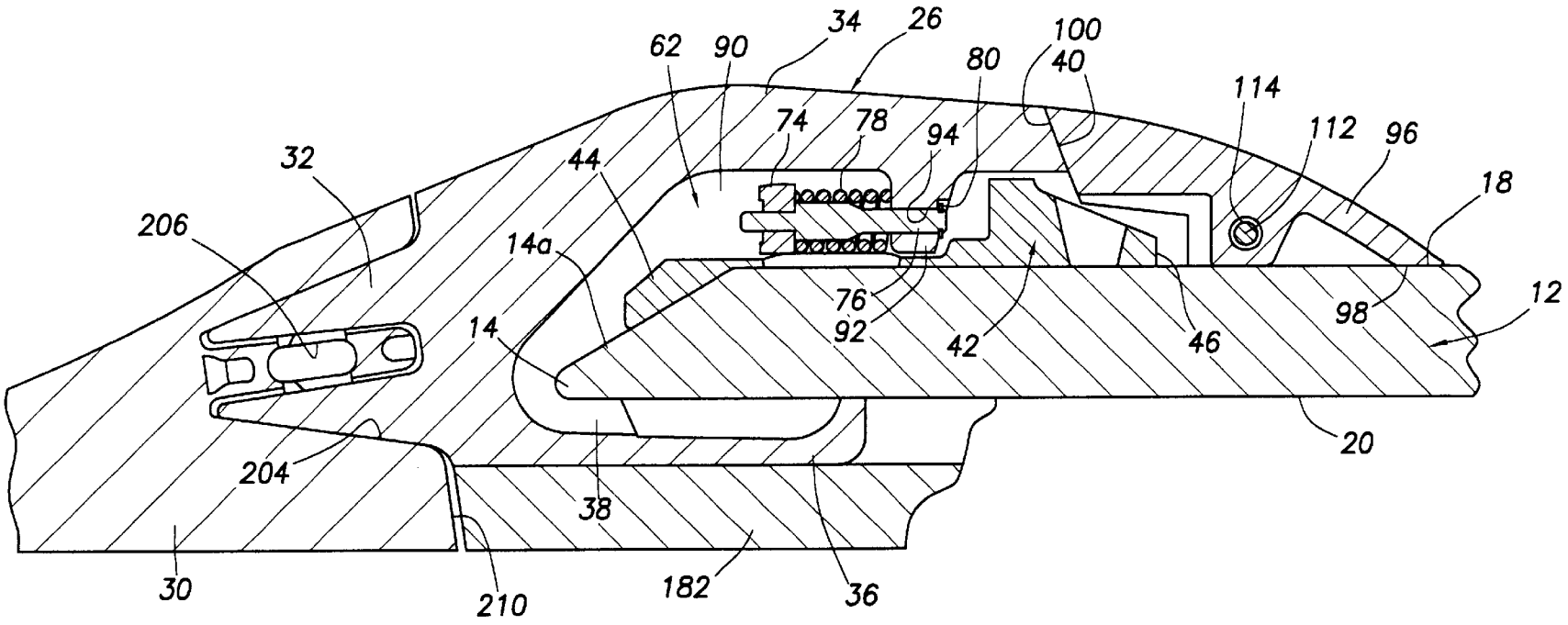
FIG. 4 is an enlarged scale cross-sectional view through the bucket taken along line 4—4 of FIG. 1.
Figure 5:
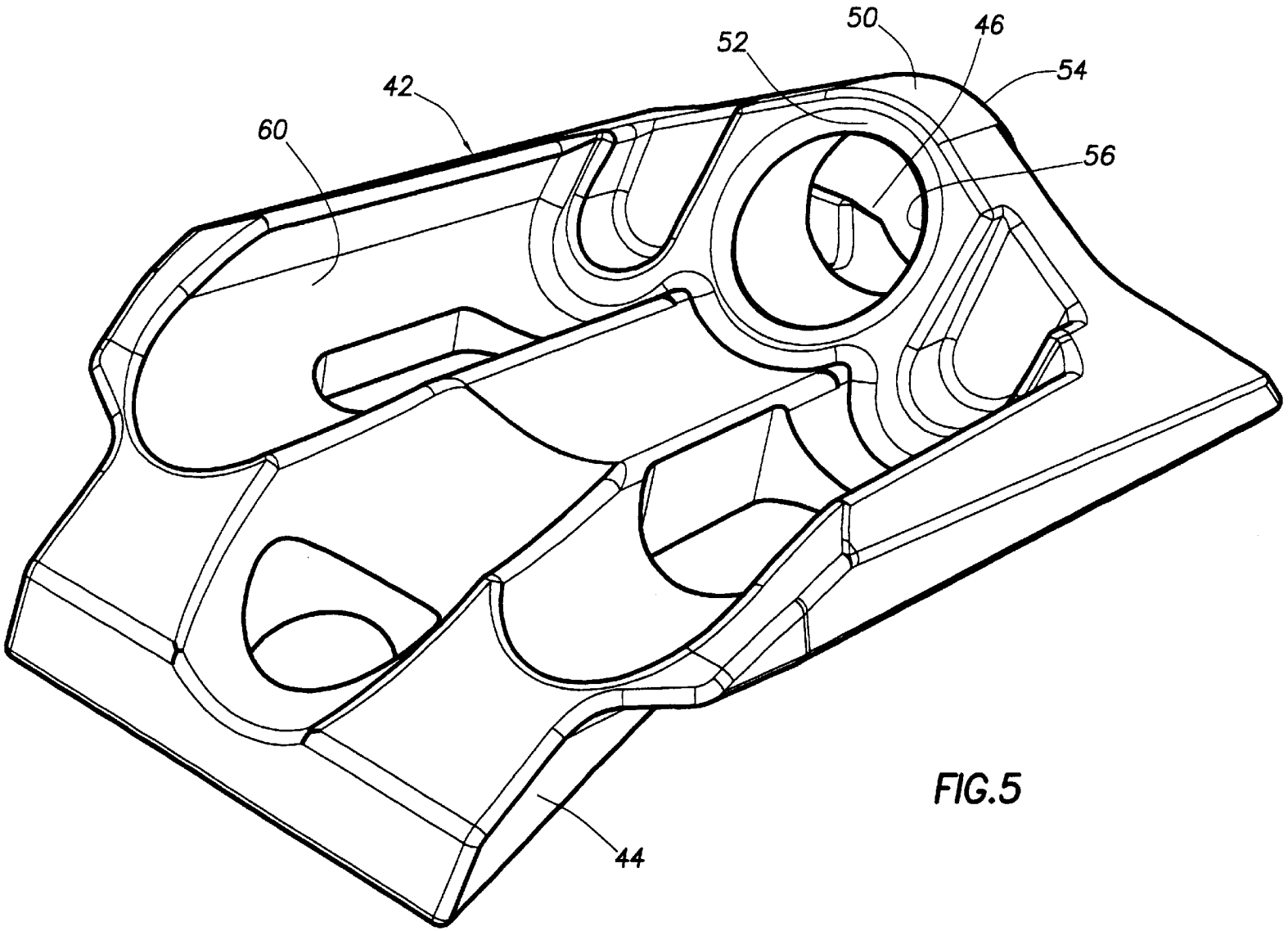
FIG. 5 is a front and right side top perspective view of an adapter mounting base portion of the wear protection system.

This captive retention of a portion of the attachment structure 62 within the top leg depression 90, for movement with the adapter 26 onto the lip plate 12, is effected by means of a pair of bosses 92 (only one of which is visible in FIG. 4) projecting into the interior of the top adapter leg 34, from its interior surface, and having circular holes 94 extending therethrough as shown in FIG. 4. This captively retained portion of the attachment structure is installed within the interior of the top leg 34, prior to the installation of the adapter 26 on the lip plate 12, by rearwardly passing the rear ends of the side rods 76 through the boss holes 94, so that the springs 78 are interposed between the body flanges 74 and the front sides of the interiorly projecting bosses 92, and the rear ends of the rods 76 project rearwardly beyond the rear sides of the bosses 92. The snap rings 80 are then installed on the rear ends of the rods 76 to captives retain the rods 76 slidingly within the boss holes 94.

Figure 3:
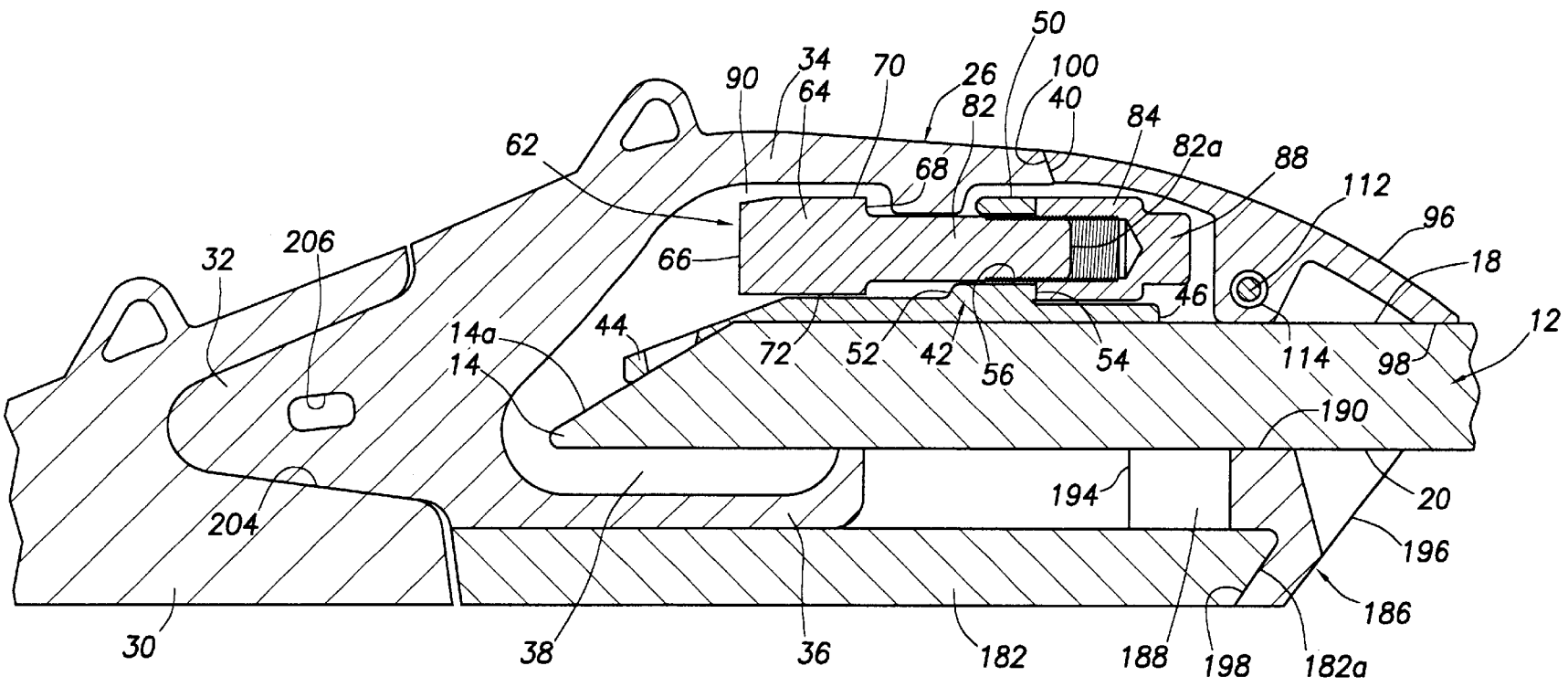
FIG. 3 is an enlarged scale cross-sectional view through the bucket taken along line 3—3 in FIG. 1.

As can be seen in FIGS. 3 and 4, with the portion 64,76,82 of the attachment structure 62 captives retained in this manner within the interior of the top adapter leg 32, the portion 64,76,82 may be moved forwardly and rearwardly relative to the top adapter leg 34, and is resiliently biased by the springs 78 in a forward direction relative to the top adapter leg 34.

When an adapter 26 is to be installed on the lip plate 12, the adapter is simply moved rearwardly onto the front edge of the lip plate 12 in a manner such that a front edge portion of the lip plate enters the adapter cavity 38 (see FIG. 3), the threaded rear end portion 82*a* of the rod 82 passes rearwardly through the hole 56 in the boss portion 50 of the connection member 42 at the lip location on which the adapter is being installed, and a lower side section of the attachment structure portion captively retained within the interior Of the top adapter leg 34 is downwardly and complementarily received in the rear top side recess 60 (see FIGS. 6 and 7) of its associated connection member.

Next, the nut member 84 is threaded onto the nut end portion 82*a* projecting rearwardly beyond the boss 50 and tightened in a manner drawing the attachment structure body 64 rearwardly toward the connecting member boss 50 and thereby compressing the springs 78 (see FIG. 4) between the body flanges 74 and the internal bosses 92 within the interior of the top adapter leg 34. The compressed springs 78 maintain a continuous rearward biasing force on the now installed adapter 26 that resiliently urges its front portion 32 rearwardly toward the front lip plate edge 14 to thereby maintain a resilient rearward tightening force on the adapter 26 to automatically compensate for operational wear at the adapter/lip interface area. The complementary engagement between the faceted areas 58,86 on the nut 84 and the boss 50 (see FIG. 6) help to keep the nut 84 from loosening during use of the bucket 10.

With the adapter 26 installed on the lip plate 12 in this manner (see FIG. 7), the nut 84 is exposed at the open rear end 40 of the top adapter leg 34. TO cover the exposed nut 84, provide the rear end of the top adapter leg 34 with a more streamlined configuration, and to substantially seal off the interior of the top adapter leg 34 from the entry thereinto of abrasive excavating material which could damage or interfere with the resilient biasing action of the attachment structure 62 captively retained within the interior of the top adapter leg 34, a streamlined hollow protective shroud member 96 is installed at the open rear end 40 of each of the top legs 34 of the adapters 26.

Turning now to FIGS. 1, 3, 4, 7 and 8, each of these shroud members 96 has an open bottom side 98, a front end face 100, and a pair of opposite side walls 102 with grooves 104 and circular openings 106 formed therein. Each shroud member 96 is releasably held on the rear end of its associated top adapter leg 34 by means of an interlock between the grooves 104 and an opposing pair of flanges 108 on the rear end of the top adapter leg 34 (see FIG. 7), and a retaining pin structure 110 (also shown in FIG. 7) having an elongated metal pin member 112, and a pair of annular resilient bushing structures 114 which are carried in the two opposing shroud member circular openings 106.

After the adapter 26 is mounted on the lip plate 12 as previously described, the rear shroud member 96 is installed on the open rear end of the top adapter leg 34 by moving the shroud member 96 forwardly toward the rear end of the top adapter leg 34 until the adapter leg flanges 108 (see FIG. 6) complementarily enter the shroud grooves 104, and the front end face 100 of the shroud 96 (see FIGS. 3, 4 and 8) abuts the rear end 40 of the top adapter leg 34. When this occurs, the open bottom side 98 of the shroud 96 downwardly abuts the top side 18 of the lip plate 18, and the opposite side wall holes 106 in the shroud 96 are generally aligned with opposite side wall holes 116 (one of which is visible in FIG. 7) in the rear end of the top adapter leg 34. The pin member 112 is then inserted through the resilient bushings 114 in the shroud holes 106, and the top adapter leg holes 116 to captively retain the shroud 92 on the rear end of its associated top adapter leg 34.

Referring now to FIGS. 1 and 14–17, at the left bottom corner of the excavating bucket 10 is a corner structural portion 120 of the bucket which is of a conventional construction, defines an end portion of the lip structure, and is similar to a right corner structural portion (not shown) of the bucket. Corner structural portion 120 includes a horizontally oriented base plate member 122 having inner and outer sides 124 and 126, top and bottom sides 128 and 130, and front and rear ends 132 and 134; a vertical first plate member 136 welded to an outer top side portion of the base plate member 122 and projecting upwardly therefrom, and a somewhat narrower second plate member 138 welded to the top end of the first plate member 136 and extending upwardly therefrom. A bucket bottom side wall 140 (shown in phantom in FIG. 1) is welded to the rear edge 16 of the lip plate 12, and the rear end 134 of the base plate member 122, and extends rearwardly therefrom. Additionally, a vertical left side wall 142 of the bucket 10 (also shown in phantom in FIG. 1) projects upwardly from the left edge of the bottom wall 140 and is welded to rear edge portions of the vertical corner plates 136 and 138.

As previously mentioned, the corner adapter **26*a* has a configuration different from the configurations of the other adapters 26 illustrated in FIG. 1. Specifically, and with reference now to FIGS. 14, 15 and 17, the corner adapter 26*a* has a front portion 32*a* from which top and bottom legs 34*a*,36*a* rearwardly along a cavity 38*a*. Top leg 34*a* has a front portion 144, a slot 146 extending rearwardly from the front portion 144, a rearwardly projecting tab 148 with a circular opening 150 therein, and a downturned inner side portion 151. On the outer side of the corner adapter 26*a* is a vertical wall 152 that extends between the top and bottom legs 34*a*,36*a***.

Figure 15:
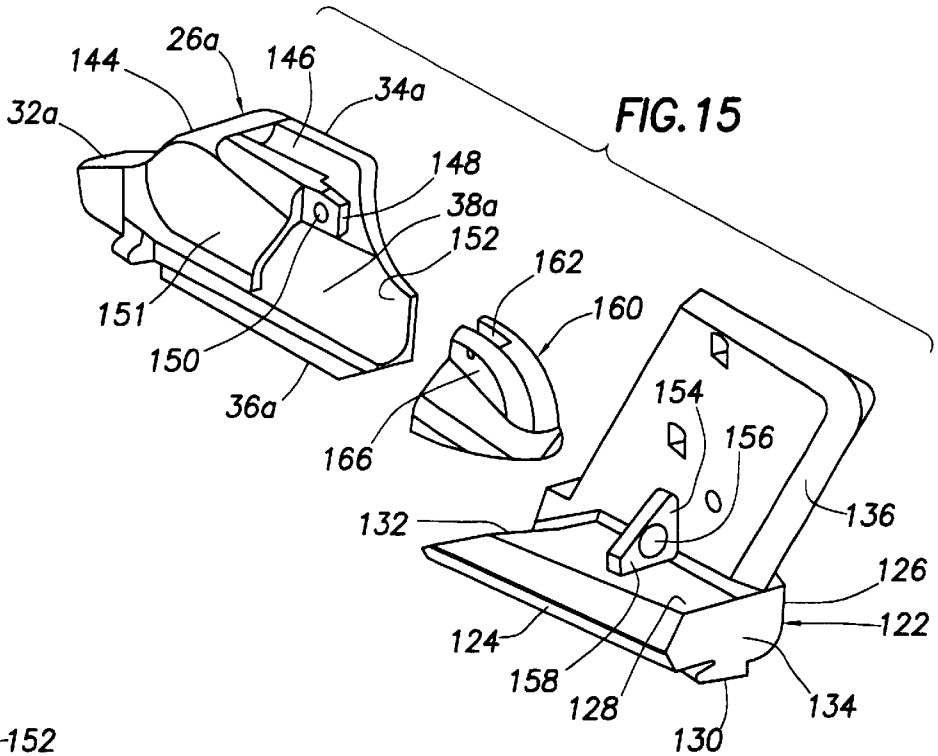
FIG. 15 is a partially exploded perspective view of part of the excavating bucket corner portion shown in FIG. 14.
Figure 14:
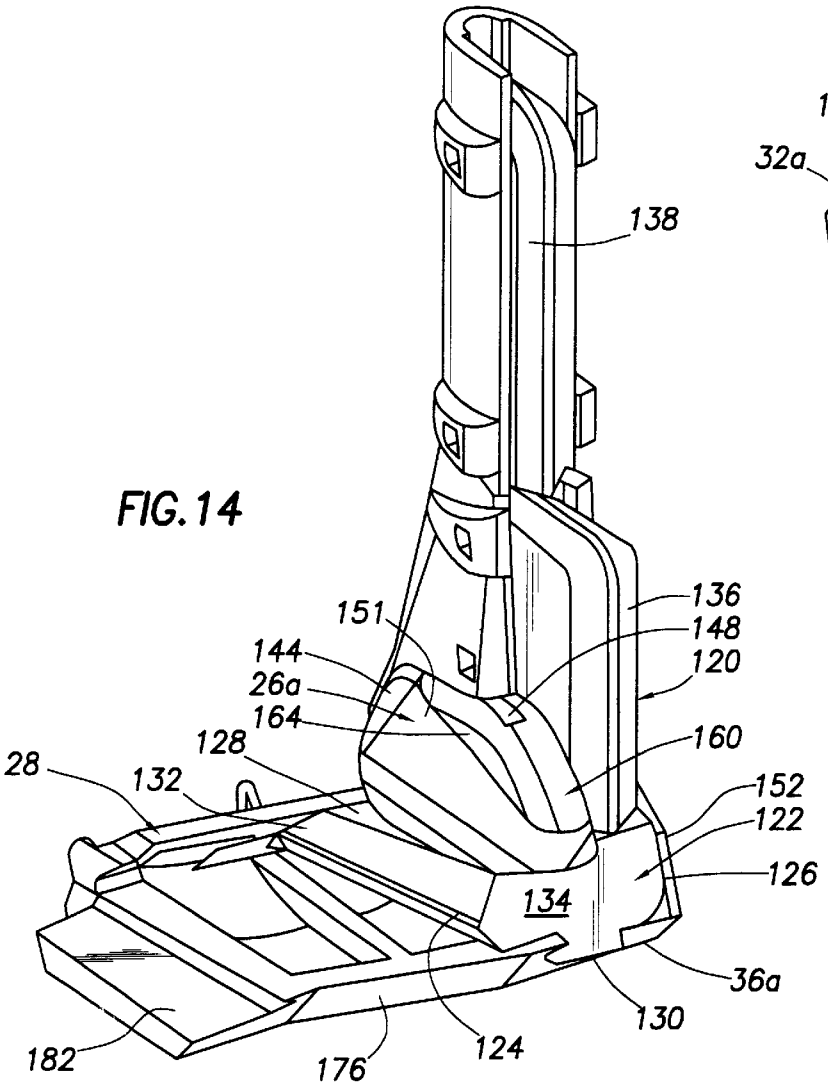
FIG. 14 is a rear perspective view of a corner portion of the excavating bucket.
Figure 16:
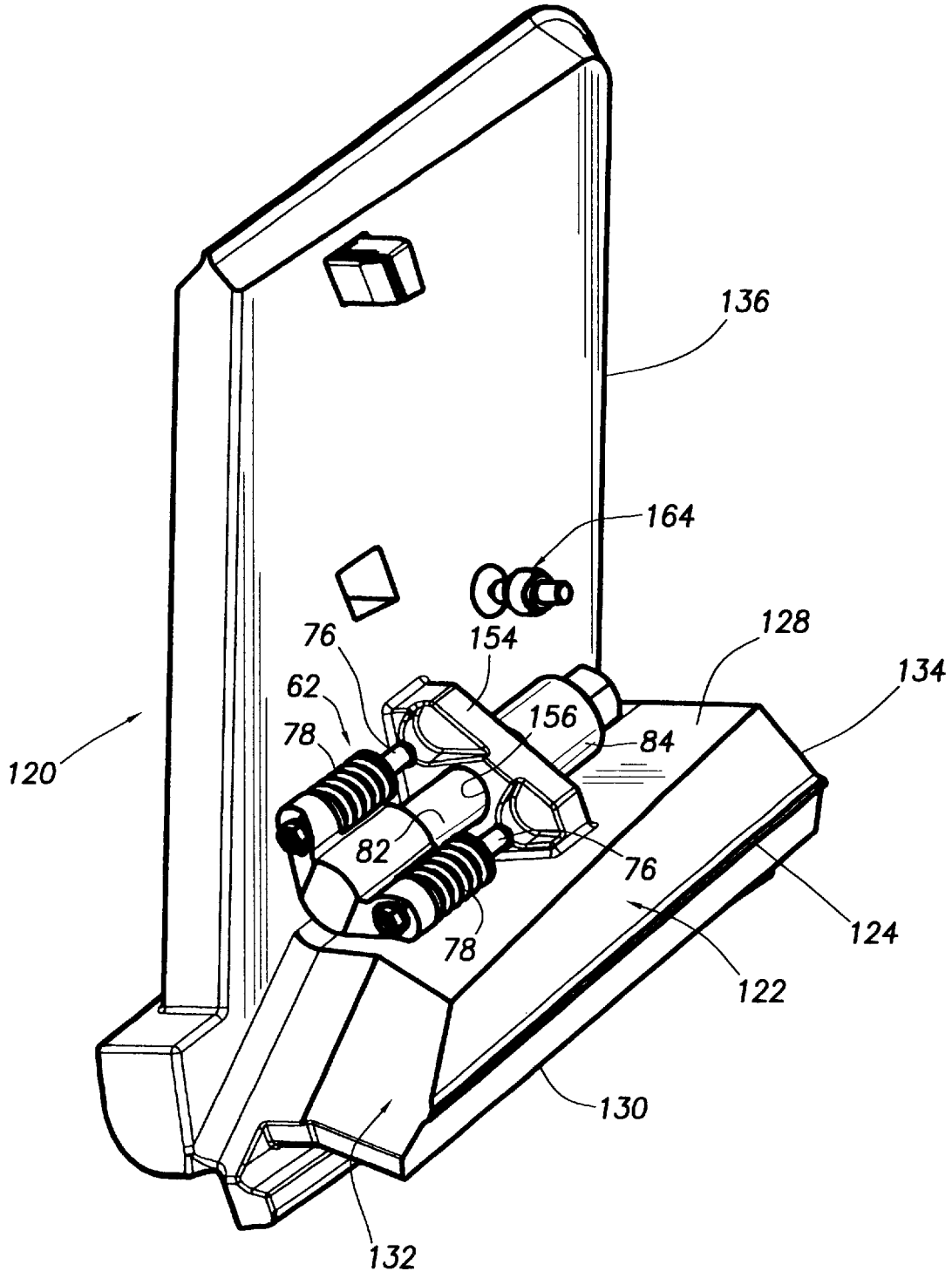
FIG. 16 is a front perspective view of the corner portion of the excavating bucket, with portions thereof having been removed for purposes of illustrative clarity.

An attachment structure 62 (see FIG. 16) identical to the previously described attachment structures 62 used in conjunction with the adapters 26 is captively retained in a similar manner within the corner adapter **26*a* and is utilized in conjunction with a connection member in the form of a bracket 154 (see FIG. 16) welded to and extending between an inner side surface of the first plate member 136 and the top side 128 of the base plate member 122. Bracket 154 has a circular hole 156 extending therethrough, and an annular faceted area 158 circumscribing he hole 156 on the rear side of the bracket 154 as illustrated in FIG. 15**.

The corner adapter **26*a* is installed on the bucket 10 by moving the adapter 26*a* rearwardly in a manner such that the first vertical plate member 136 enters the adapter slot 146, the base plate member 122 enters the cavity 38*a*, and a rear end portion the attachment structure center rod 82 (see FIG. 16) rearwardly passes through the bracket hole 156. The nut 84 is then tightened against the rear face of the bracket 154 to rearwardly compress the attachment structure springs 78 against the internal bosses within the adapter 26*a* (not shown) that slidably carry the adapter structure side rods 76**).

With the corner adapter **26*a* installed in this manner, the front portion 144 Of its top leg 34*a* overlies and protects from abrasion a front side area of the corner bucket structural portion 120; its horizontally opposite vertical side wall portions 151,152 overlie and protect from abrasion horizontally inner and outer opposite side surface areas of the corner bucket structural portion 120, and the bottom adapter leg 36*a* overlies and protects from abrasion a bottom side area of the corner bucket structural portion 120, as shown in FIGS. 1 and 14–17**.

After the corner adapter **26*a* has been installed, a hollow rear end shroud 160 (see FIGS. 1 and 14–16) is installed over the open rear end of the corner adapter 26*a*. On its top side, the shroud 160 has a notch 162 (see FIG. 15) that receives the adapter tab 148. To releasably retain the shroud 160 in place on the corner adapter 26*a*, a retaining pin structure 164 (see FIG. 16) is operatively placed in circular holes 166 on opposite sides of the shroud 160, and in the adapter tab hole 150 disposed between the holes 166**.

The installed shroud 160 also provides abrasion protection for a section of the corner bucket structural portion 120. In addition to this abrasion protection, conventional wear shroud members 168,170 (see FIGS. 1 and 14) are suitably secured to front edge portions of the vertical structural plate members 136 and 138.

With reference now to FIGS. 1, 3, 4 and 9–13, each of the lip protectors 28 has a tapered front edge portion 172 with a notch 174 at its rear side, a body portion 176 extending rearwardly from the front edge portion 172 and having top and bottom sides 178,180 and a pair of opposite side flanges 182. For purposes later described herein opposite left and right side projections 184 are formed on the front edge portions 172.

As illustrated in FIGS. 3 and 9–13, the excavating bucket 10 also includes a spaced series Of base members 186. Each base member 186 has a top wall 188 with a top side 190, opposite side edge depressions 192 and a front end 194, and a forwardly and downwardly sloped rear wall 196 with an angled depression 198 (see FIG. 3) formed in a front side thereof. The top sides 190 of the base members 186 are welded to the bottom side 20 of the lip plate 12 in a manner positioning the base members rearwardly apart from the front lip plate edge 14 and aligned with the adapter mounting locations on the lip plate 12.

With the adapters 26 removably secured to the lip plate 12 as previously described herein, the lip protectors 28 are slid rearwardly into place on the lip plate 12 in an interdigitated relationship therewith as can be best seen in FIG. 1. After the lip protectors 28 are rearwardly slid into place in this manner they releasably interlock with the lip plate 12, the adapters 26 and the support members 186 in various manners.

Figure 9:
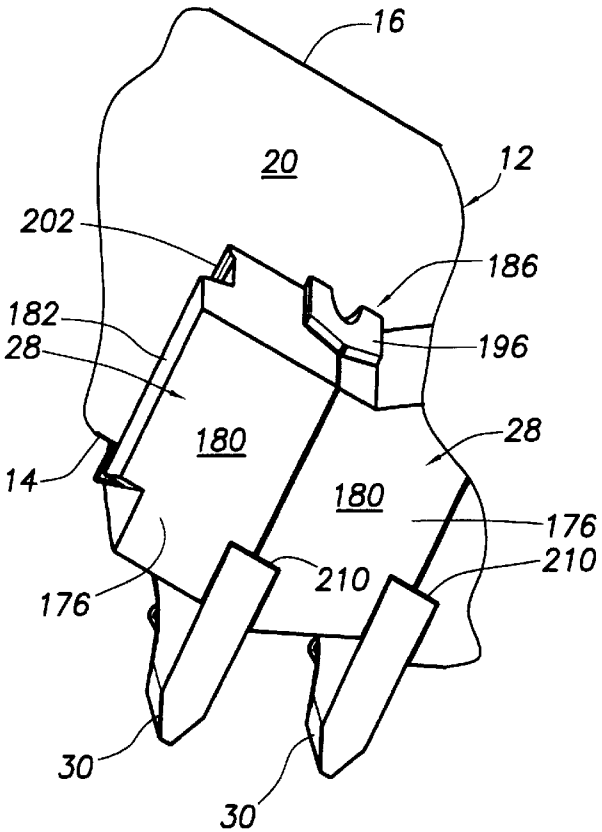
FIG. 9 is a bottom rear side perspective view of a portion Of the excavating bucket illustrating lip protectors interdigitated with the excavating teeth assemblies.
Figure 11:
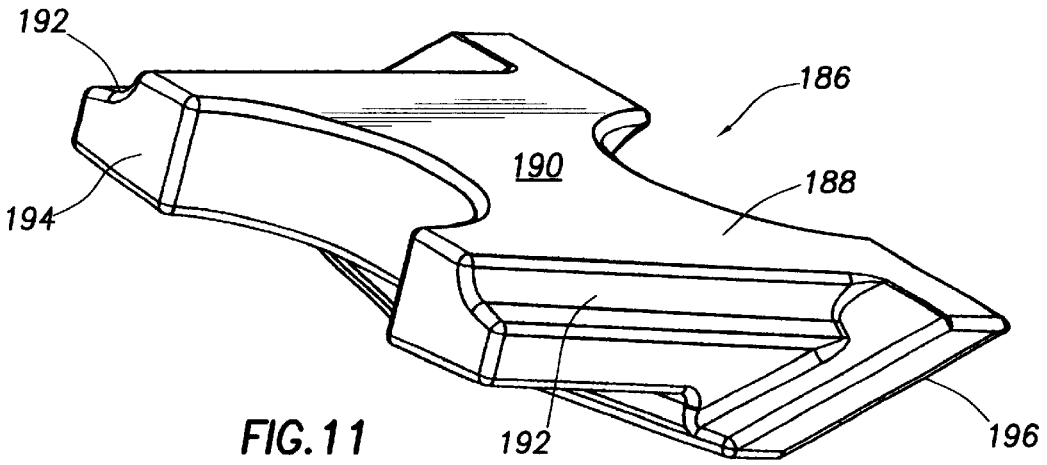
FIG. 11 is a front and right side top perspective view of one of the base members.
Figure 12:
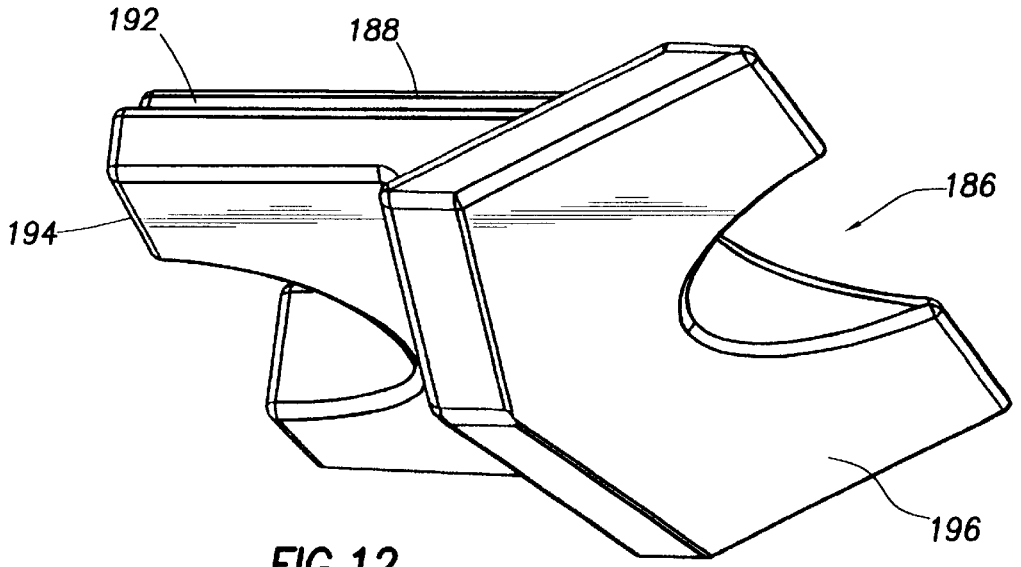
FIG. 12 is a rear and right side bottom perspective view of the base member shown in FIG. 11.
Figure 13:
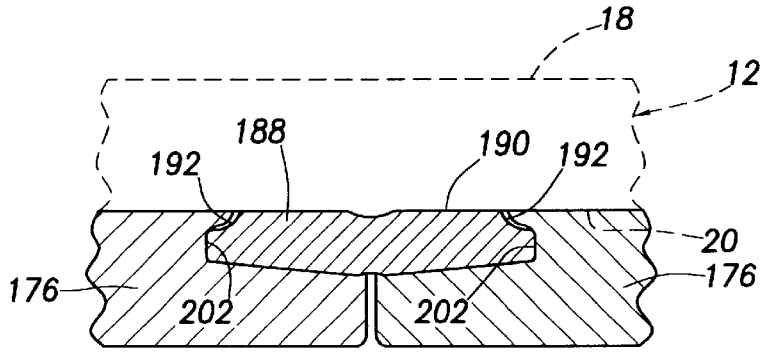
FIG. 13 is an enlarged scale cross-sectional view through a pair of lip protectors, and an associated base member with which they are releasably interlocked, taken along line 13—13 of FIG. 10.

Specifically, as best illustrated in FIG. 1 the front lip edge 14 enters the complementarily configured rear side notches 174 in the lip protectors 28, with the front edge portions 172 of the lip protectors 28 being interdigitated with the top adapter legs 26 as shown in FIG. 1. Additionally, sloped rear end portions 182*a* of the lip protector side flanges 182 are complementarily received in the front side depressions 198 of the rear support member walls 196 (see FIG. 3), and the forwardly disposed opposite side projections 184 on the lip protectors 28 (see FIG. 10) are received in complementarily configured opposite side grooves 200 in the adapters 26 (see FIGS. 2 and 7). Opposite rear corner portions of the lip protector bodies 176 are received in the edge depressions 192 of the support members 186 (see FIGS. 10 and 13), and opposite side edge portions of the top support member walls 188 (see FIG. 13) are complementarily received in corresponding cutout areas 202 in facing edge portions of the lip protector bodies 176. As illustrated in FIGS. 3 and 9, with the lip protectors 28 slid rearwardly into place on the lip plate 12 in this interlocking manner, the lip protector side flanges 182 underlie the bottom adapter legs 36 and shield them from abrasion wear.

With the lip protectors 28 on the lip plate 12, the replaceable tooth points 30 are installed on the adapters by placing the front adapter portions or "noses" 32 into complementarily configured rearwardly opening sockets 204 (see FIGS. 3 and 4) and then inserting suitable connecting pins (not shown) or other connecting structures into aligned holes 206,208 respectively extending through the adapter noses 32 and opposite side wall portions of their associated tooth points 30. As best illustrated in FIGS. 3, 4 and 9, rear end surface portions 210 of the installed tooth points 30 block forward movement of the installed lip protectors 28, thereby captively retaining the lip protectors 28 on the lip plate 12 without the necessity of using fastening members of any sort to accomplish this task.

As can be seen from the foregoing, the use of the specially designed attachment structures 162 provides the adapters 26 with substantially reduced maximum projected frontal areas, thereby improving the operational efficiency of the excavating bucket 10. Moreover, the use of the rear end shrouds on the adapters shields their captively retained attachment structures 162 from abrasive material and additionally gives the rear ends of the overall tooth/adapter structures a considerably more streamlined configuration, thereby reducing that amount of excavating material retained in the bucket at these rear end locations and desirably increasing the buckets operational payload. Additionally, as previously described herein, the specially configured corner adapter 26*a* provides substantially enhanced abrasion shielding for the overall corner structural portion 120 of the excavating bucket 10.

The foregoing detailed description is to be clearly understood as being given by way of illustration and example only, the spirit and scope of the present invention being limited solely by the appended claims.

What is claimed is:

1. Excavating apparatus comprising:

a wear member having a generally C-shaped configuration with a front portion from which first and second legs rearwardly extend along opposite sides of a cavity adapted to removably receive a front edge portion of an excavating lip structure, said first leg having an interior area;

an attachment structure removably connectable to the excavating lip structure to removably retain said wear member thereon, said attachment structure having a portion carried within said interior area for forward and rearward movement relative to said first leg and being movable with said wear member onto said lip structure; and a biasing structure associated with said portion of said attachment structure and resiliently biasing said portion of said attachment structure forwardly relative to said first leg.

2. The excavating apparatus of claim 1 wherein said wear member is an excavating tooth adapter.

3. The excavating apparatus of claim 1 wherein said first leg is a top leg of said wear member, and said second leg is a bottom leg of said wear member.

4. The excavating apparatus of claim 1 wherein:

said first leg has an inner side, and said interior area is defined by a depression extending inwardly through said inner side.

5. The excavating apparatus of claim 4 wherein:

said first leg has a rear end, said depression opens outwardly through said rear end, and said excavating apparatus further comprises a shroud structure removably connectable to said rear end to cover the rear end of said depression.

6. The excavating apparatus of claim 5, wherein said shroud structure and said rear end of said first leg have releasably interlockable portions.

7. The excavating apparatus of claim 6 wherein:

said rear end of said first leg has a first pair of mounting holes disposed on opposite sides thereof, said shroud structure has a second pair of mounting holes disposed on opposite sides thereof and alignable with said first pair of mounting holes, and said excavating apparatus further comprises a retaining pin structure releasably receivable in the aligned first and second pairs of mounting holes.

8. The excavating apparatus of claim 1 wherein:

said first leg has a projecting portion extending into said interior area, said attachment structure portion includes:

a body portion, a first portion extending rearwardly from said body portion and being slidably interengaged with said projecting portion for forward and rearward movement relative thereto, and a second portion extending rearwardly from said body portion, said second portion being securable to the excavating lip structure and being rearwardly movable relative to said projecting portion to move said body portion rearwardly toward said projecting portion, and said biasing structure includes a spring structure interposed between said body portion and said projecting portion and being compressible therebetween in response to movement of said body portion toward said projecting portion.

9. The excavating apparatus of claim 8, wherein:

said projecting portion includes a spaced pair of bosses having openings extending therethrough, said first portion includes a spaced pair of parallel first and second rods extending rearwardly from said body portion and slidably received in said boss openings, said second portion includes a third rod extending rearwardly from said body portion parallel to and between said first and second rods, and said spring structure includes a pair of coiled compression springs circumscribing said first and second rods between said body portion and said bosses.

10. The excavating apparatus of claim 9 further comprising retaining structures carried by said first and second rods and captively retaining them in said boss openings.

11. The excavating apparatus of claim 9 wherein:

said third rod has a threaded rear end portion, and said attachment structure further includes a nut member threadable onto said threaded rear end portion of said third rod.

12. The excavating apparatus of claim 11, wherein said nut member has an axially elongated configuration and a faceted front end surface.

13. The excavating apparatus of claim 1 wherein said portion of said attachment structure is captively retained within said interior area of said first leg.

14. The excavating apparatus of claim 1 wherein:

the excavating lip structure has an end portion perpendicularly connected to a wall structure at a corner section of an excavating bucket, and said wear member is configured to removably receive said corner section and overlie and shield from abrasion inner and outer side portions of the wall structure.

15. The excavating apparatus of claim 14 wherein:

said wear member is additionally configured to shield from abrasion a bottom side portion of said lip structure adjacent the wall structure.

16. The excavating apparatus of claim 14 wherein:

said wear member is additionally configured to shield from abrasion a front edge portion of the wall structure.

17. Attachment apparatus useable to removably attach a wear member to an excavating lip structure, comprising:

a body;

first and second spaced apart, parallel rods longitudinally extending outwardly from said body and being slidably receivable in portions of the wear member;

first and second coiled compression springs configured to respectively receive said first and second rods;

a third rod longitudinally extending outwardly from said body and disposed between said first and second rods in a parallel relationship therewith, said third rod having a threaded rear end portion and being slidably receivable in a portion of said excavating lip structure; and a nut member threadable onto said rear end portion of said third rod.

18. The attachment apparatus of claim 17 wherein said nut member has a faceted front end surface.

19. The attachment apparatus of claim 17 further comprising:

a base member anchorable to a top side portion of the excavating structure and having a portion with a hole therein through which said third rod may be slidingly extended in a rearward direction.

20. The attachment apparatus of claim 19 wherein:

said base member has a top side with a recess disposed therein and configured to downwardly receive said body and said first, second and third rods.

21. Excavating apparatus comprising:

an excavating lip structure having a length and a front edge portion extending along said length;

a series of connection sections carried on said front edge portion and spaced apart along said length;

a series of wear members spaced apart along said length and aligned with said series of connection sections, each of said series of wear members having a generally C-shaped configuration with a front portion from which first and second legs rearwardly extend along opposite sides of a cavity removably receiving a part of said front edge portion, said first leg having an interior area;

attachment structures associated with said wear members, and removably securing said wear members to said excavating lip structure, each of said attachment structures having a portion (1) supported within the interior area of the first leg of its associated wear member for movement with the associated wear member onto said front edge portion of said excavating lip structure, (2) removably connected to one of said connection sections, and (3) forwardly and rearwardly movable relative to the associated wear member and the connection section: and biasing structures associated with said attachment structures and resiliently biasing said wear members rearwardly relative to said front edge portion of said excavating lip structure.

22. The excavating apparatus of claim 21 wherein each of said wear members is an excavating tooth adapter.

23. The excavating apparatus of claim 21 wherein, in each of said wear members, said first leg is a top leg of said wear member, and said second leg is a bottom leg of said wear member.

24. The excavating apparatus of claim 21 wherein each of said first legs has an inner side, and said interior area of each of said first legs is defined by a depression extending inwardly through its inner side.

25. The excavating apparatus of claim 24 wherein:

each of said first legs has a rear end, each of said depressions opens outwardly through the rear end of its associated first leg, and said excavating apparatus further comprises shroud structures removably connected to said rear ends of said first legs and covering the rear ends of their depressions.

26. The excavating apparatus of claim 25 wherein, in each of said first legs, said shroud structure and said rear end of said first leg have releasably interlocked portions.

27. The excavating apparatus of claim 26 wherein:

each of said rear ends of said first legs has a first pair of mounting holes disposed on opposite sides thereof, each of said shroud structures has a second pair of mounting holes disposed on opposite sides thereof and aligned with one of said first pairs of mounting holes, and said excavating apparatus further comprises retaining pin structures releasably received in the aligned first and second pairs of mounting holes.

28. The excavating apparatus of claim 21 wherein, in each of said series of wear members:

said first leg has a projecting portion extending into the interior area thereof, said attachment structure portion includes:

a body portion disposed forwardly of said projecting portion, a first portion extending rearwardly from said body portion and being slidably interengaged with said projecting portion for forward and rearward movement relative thereto, and a second portion extending rearwardly from said body portion, said second portion being secured to one of said connection sections and being rearwardly movable relative to said projecting portion to move said body portion rearwardly toward said projecting portion, and said biasing structure includes a spring structure interposed between said body portion and said projecting portion and being compressible therebetween in response to movement of the body portion toward said projecting portion.

29. The excavating apparatus of claim 28 wherein, in each of said series of wear members:

said projecting portion includes a spaced pair of bosses having openings extending therethrough, said first portion includes a spaced pair of parallel first and second rods extending rearwardly from said body portion and slidably received in the openings in said spaced pair of bosses, said second portion includes a third rod extending rearwardly from said body portion parallel to and between said first and second rods, and said spring structure includes a pair of coiled compression springs circumscribing said first and second rods between said body portion and said bosses.

30. The excavating apparatus of claim 29 further comprising retaining structures carried by said first and second rods and captively retaining them in their associated boss openings.

31. The excavating apparatus of claim 29 wherein each of said connection sections has a hole extending therethrough between front and rear side surface portions thereof, and, in each of said attachment structures:

said third rod has a threaded rear end portion and extends rearwardly through one of said connection section holes, and said attachment structure further includes a nut member threaded onto the threaded rear end portion of said nut member, bearing against the rear side surface portion of the associated connection section, and maintaining the springs on said first and second rods in compression.

32. The excavating apparatus of claim 31 wherein:

each of said nut members has an axially elongated configuration with a faceted front end surface complementarily engaging a faceted rear side surface area of the associated connection section.

33. The excavating apparatus of claim 21 wherein, in each of said first legs, said portion of said attachment structure is captively retained within said interior area of the first leg.

34. The excavating apparatus of claim 21 wherein:

said excavating lip structure has an end portion perpendicularly connected to a wall structure at a corner section of an excavating bucket, and one of said wear members is a corner wear member removably receiving said corner section and overlying and shielding from abrasion inner and outer side portions of said wall structure.

35. The excavating apparatus of claim 34 wherein said corner wear member additionally shields from abrasion a bottom side portion of said lip structure adjacent said wall structure.

36. The excavating apparatus of claim 34 wherein:

said corner wear member additionally shields from abrasion a front edge portion of said wall structure.

37. The excavating apparatus of claim 21 wherein:

said excavating lip structure has top and bottom sides, said first legs of said wear members overlie said top side, said second legs of said wear members underlie said bottom side, and said excavating apparatus further comprises a series of lip protectors captively and releasably retained on said front edge portion of said excavating lip portion, said lip protectors having top side portions interdigitated with said first legs of said wear members and bottom side portions underlying said second legs of said wear members and shielding them from abrasion.

38. The excavating apparatus of claim 37 wherein:

said excavating apparatus further comprises a series of support members spaced apart along the length of said front edge portion of said excavating lip structure and projecting downwardly from its bottom side, and said lip protectors are releasably interlocked with said support members and said wear members and forwardly removable from said front edge portion of said excavating lip structure.

39. The excavating apparatus of claim 38 wherein:

said wear members are excavating tooth adapters, and said excavating apparatus further comprises a series of excavating tooth points removably mounted on said front portions of said tooth adapters and blocking the forward removal of said lip protectors from said front edge portion Of said excavating lip structure.

* * * * *